US008807794B2

(12) United States Patent
Huang et al.

(10) Patent No.: US 8,807,794 B2
(45) Date of Patent: Aug. 19, 2014

(54) ILLUMINATION DEVICE

(75) Inventors: Tien-Fu Huang, Hsinchu County (TW); Sheng-Chiang Peng, Hsinchu (TW); Shih-Hao Hua, Changhua County (TW); Chi-Hua Yu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 337 days.

(21) Appl. No.: 13/439,872

(22) Filed: Apr. 5, 2012

(65) Prior Publication Data

US 2013/0135854 A1 May 30, 2013

(30) Foreign Application Priority Data

Nov. 30, 2011 (TW) ..... 100143991 A

(51) Int. Cl.
*F21V 21/00* (2006.01)

(52) U.S. Cl.
USPC ..... 362/249.02; 362/249.06; 362/800; 313/511

(58) Field of Classification Search
USPC ..... 362/249.04, 249.06, 646, 800; 313/511
See application file for complete search history.

(56) References Cited

U.S. PATENT DOCUMENTS

| | | | | |
|---|---|---|---|---|
| 6,371,637 | B1 * | 4/2002 | Atchinson et al. | 362/249.04 |
| 8,461,748 | B1 * | 6/2013 | Taj | 313/46 |
| 2011/0155460 | A1 | 6/2011 | Wang et al. | |
| 2011/0176297 | A1 | 7/2011 | Hsia et al. | |

FOREIGN PATENT DOCUMENTS

| | | |
|---|---|---|
| CN | 101666439 | 3/2010 |
| CN | 201589090 | 9/2010 |
| CN | 102182950 | 9/2011 |
| CN | 102203501 | 9/2011 |
| CN | 102235605 | 11/2011 |
| DE | 10326368 | 12/2004 |
| JP | 2005531111 | 10/2005 |
| TW | 519215 | 1/2003 |
| TW | M298301 | 9/2006 |
| TW | 200843602 | 11/2008 |
| TW | M368025 | 11/2009 |
| TW | M395239 | 12/2010 |
| TW | M403720 | 5/2011 |
| TW | 201124007 | 7/2011 |
| TW | M412319 | 9/2011 |

OTHER PUBLICATIONS

"Office Action of Taiwan Counterpart Application", issued on Oct. 4, 2013, p. 1-p. 4.
"Office Action of China Counterpart Application", issued on May 26, 2014, p. 1-p. 5.

* cited by examiner

*Primary Examiner* — Stephen F Husar
(74) *Attorney, Agent, or Firm* — Jianq Chyun IP Office

(57) ABSTRACT

An illumination device includes a base, a flexible circuit board disposed on the base, and a plurality of illumination units. The flexible circuit board has a plurality of first branches and at least one second branch which are connected together. Each of the first branches has a radius of curvature, and the radii of curvature of the first branches are different from or identical to one another, so that the first branches are assembled to form a curved surface. The second branch extends from one of the first branches. After the first branches are assembled, the second branch is overlapped with another first branch. The illumination units are packaged onto the first branches of the flexible circuit board. Here, the illumination units located on one of the first branches is electrically connected to the illumination units located on another of the first branches through the second branch.

6 Claims, 5 Drawing Sheets

ILLUMINATION DEVICE

CROSS-REFERENCE TO RELATED APPLICATION

This application claims the priority benefit of Taiwan application serial no. 100143991, filed on Nov. 30, 2011. The entirety of the above-mentioned patent application is hereby incorporated by reference herein and made a part of this specification.

BACKGROUND OF THE DISCLOSURE

1. Technical Field

The disclosure relates to an illumination device. More particularly, the disclosure relates to an illumination device of a light emitting diode (LED).

2. Background

Owing to the characteristics of long life span and low power consumption, a light emitting diode (LED) has been broadly applied to large electronic display bulletins, traffic lights, and direction indicating lights, for instance. The existing LED industry is advancing toward the goal of high brightness and low light loss, such that the LED is able to replace conventional illumination means. Further, the LED will gradually serve as a future projection light source with high brightness; for instance, the LED is applicable to a digital light processing (DLP) projector, a liquid crystal display (LCD) projector, and any other color optical projection device with high brightness.

An exemplary conventional LED illumination device mainly includes a red LED, a green LED, and a blue LED. After the red light emitted from the red LED, the green light emitted from the green LED, and the blue light emitted from the blue LED are mixed, white color can be output. Nonetheless, the light emitted from the existing LED is shaped as a straight line and is not in a scattering state as is the light emitted from a conventional tungsten filament lamp or a conventional fluorescent lamp. The light in form of a straight line can merely be condensed to one point, while other ambient light beams are unable to be condensed. Accordingly, the illumination range is limited, or the brightness easily appears to be insufficient.

SUMMARY

The disclosure is directed to an illumination device with a desirable light emitting efficiency.

In an exemplary embodiment of the disclosure, an illumination device that includes a base, a flexible circuit board, and a plurality of illumination units is provided. The flexible circuit board is configured on the base. Besides, the flexible circuit board has a plurality of first branches and at least one second branch which are connected together. Each of the first branches has a radius of curvature, and the radii of curvature of the first branches are identical to or different from one another, such that the first branches are assembled to form a curved surface. The second branch extends from one of the first branches. After the first branches are assembled, the second branch is overlapped with another of the first branches.

Based on the above, the flexible circuit board in the illumination device is divided into the first branches, as described in the exemplary embodiments of the disclosure. Each of the first branches has a fixed radius of curvature, and the radii of curvature of the first branches are identical to or different from one another. Hence, after the first branches are assembled, the flexible circuit board with a curved profile can be formed, and the illumination units packaged on the flexible circuit board may emit light towards different directions. Thereby, in this disclosure, the scattering effect can be achieved as is accomplished by the conventional illumination device.

Besides, each of the first branches is assembled to one another through the second branch, and the illumination units located on one of the first branches may be electrically connected to the illumination units located on another of the first branches through the second branch. After the illumination units become three-dimensional, the electrical connections among the illumination units can be simplified effectively, and the difficulty of circuit layout on the flexible circuit board can be reduced.

Several exemplary embodiments accompanied with figures are described in detail below to further explain the disclosure.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EXEMPLARY EMBODIMENTS

Figure 1:
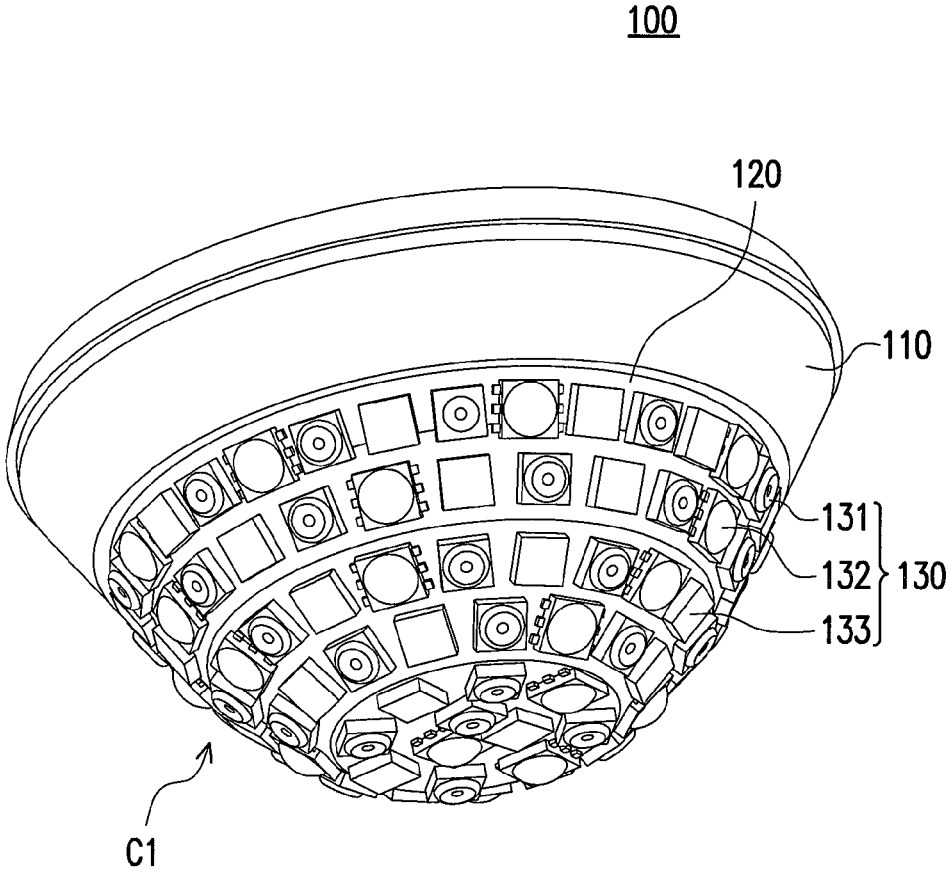
FIG. 1 is a schematic view illustrating an illumination device according to an exemplary embodiment of the disclosure.
Figure 2:
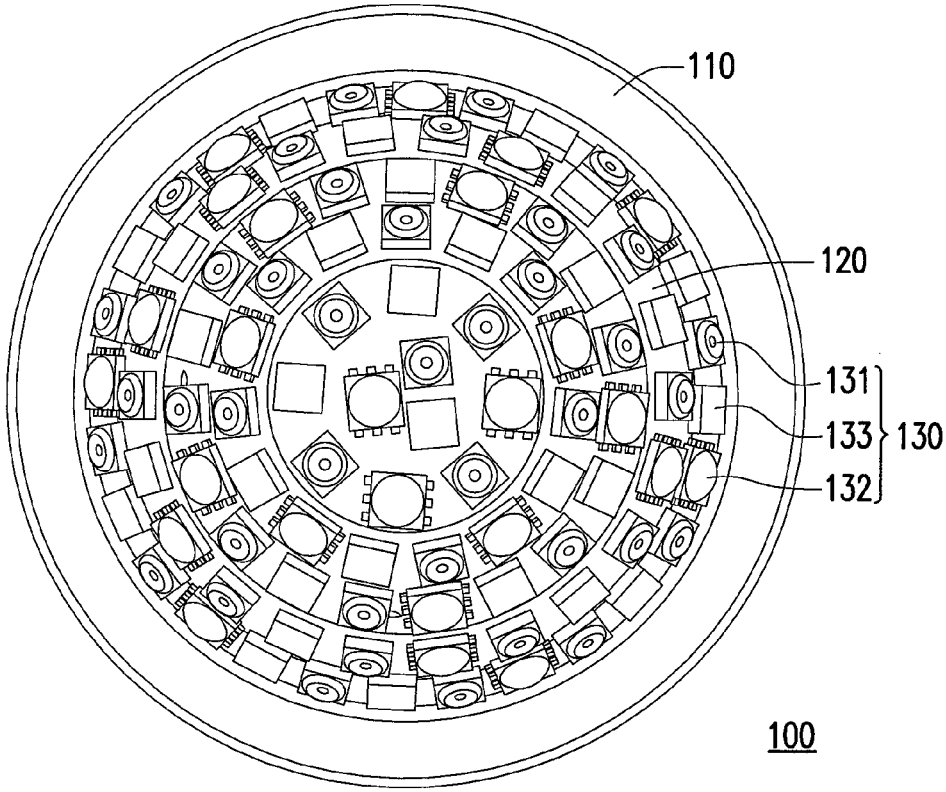
FIG. 2 and FIG. 3 are schematic views illustrating the illumination device depicted in FIG. 1 at different viewing angles.
Figure 3:
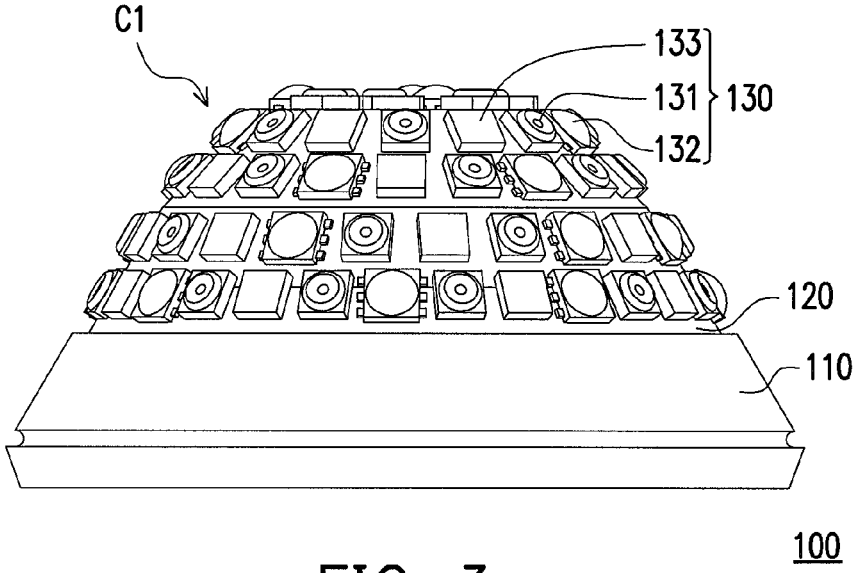
Figure 4:
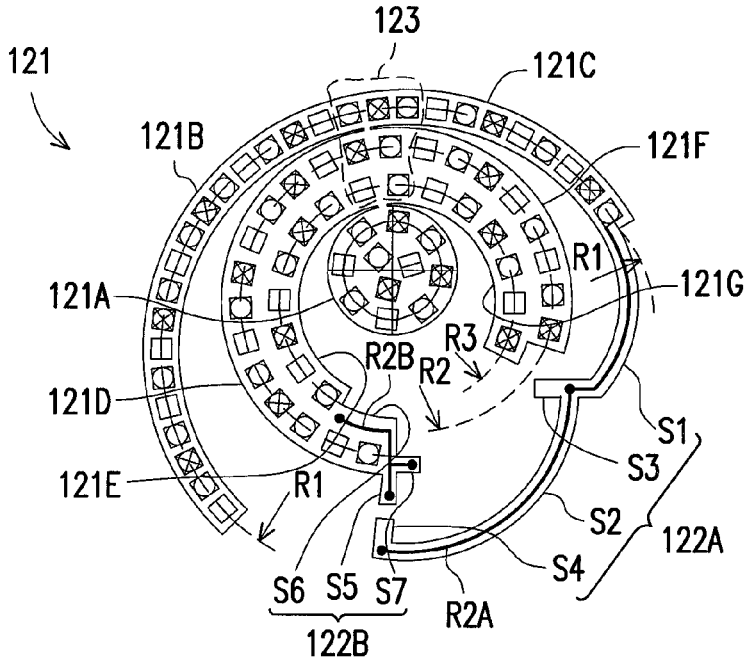
FIG. 4 is a schematic exploded view illustrating the illumination device depicted in FIG. 1.

FIG. 1 is a schematic view illustrating an illumination device according to an exemplary embodiment of the disclosure. FIG. 2 and FIG. 3 are schematic views illustrating the illumination device depicted in FIG. 1 at different viewing angles. FIG. 4 is a schematic exploded view illustrating the illumination device depicted in FIG. 1. With reference to FIG. 1 to FIG. 4, in the present exemplary embodiment, the illumination device 100 includes a base 110, a flexible circuit board 120, and a plurality of illumination units 130 packaged on the flexible circuit board 120. Here, the illumination units 130 include one or more red LED 131, one or more blue LED 132, and one or more green LED 133, so as to generate the white light illumination effect through mixing the colors. Subject to the limited light emitting angle of the LED, the illumination units 130 are packaged on the flexible circuit board 120 and then assembled to the base 110 in the exemplary embodiment, such that the illumination device 100 can, based on the characteristics of the flexible circuit board 120, have a three-dimensional profile. Thereby, the illumination device 100 can achieve the scattering effect as is accomplished by the conventional tungsten filament lamp or the conventional fluorescent lamp.

To be more specific, the flexible circuit board 120 in the exemplary embodiment has a plurality of first branches 121, and each of the first branches 121 has a fixed radius of curvature. The radii of curvature of the first branches 121 are identical to or different from one another. Hence, after the first branches 121 are assembled, the flexible circuit board 120 with a curved surface C1 can be formed.

One way to disassemble the flexible circuit board is depicted in FIG. 4, which should however not be construed as a limitation to the disclosure. With reference to FIG. 3 and FIG. 4, in this exemplary embodiment, the curved surface C1 is a flat-topped cone, i.e., having the so-called pudding shape. After the flexible circuit board 120 is disassembled and is in an unfolded state (as shown in FIG. 4), the flexible circuit board 120 substantially includes a trunk 123. The first branches 121 can be divided into a circular branch 121A and a plurality of arc-shaped branches 121B, 121C, 121D, 121E, 121F, and 121G. The circular branch 121A is connected to an end of the trunk 123, the arc-shaped branches 121D and 121E are integrally formed, and the arc-shaped branches 121F and 121G are integrally formed. In the present exemplary embodiment, note that the arc-shaped branches 121B, 121C, 121D, 121E, 121F, and 121G having the same radius of curvature respectively extend from the trunk 123 to two respective sides differing from the circular branch 121A.

For instance, the arc-shaped branches 121B and 121C have the same radius R1 of curvature, the arc-shaped branches 121D and 121F have the same radius R2 of curvature, and the arc-shaped branches 121E and 121G have the same radius R3 of curvature. Thereby, after the first branches 121 with different radii of curvature are assembled, the illumination device 100 with the curved surface C1 can be formed, as shown in FIG. 1 to FIG. 3.

The shape of curved surface C1 of the flexible circuit board 120 is not limited in the present exemplary embodiment, and the curved surface may also be a dome in another exemplary embodiment (not shown). That is to say, on the premise that the flexible circuit board 120 allows the illumination units 130 packaged thereon to accomplish the three-dimensional illumination effects, the appearance of the assembled flexible circuit board 120 and the way to dissemble the flexible circuit board 120 may be properly modified. For instance, a designer can adapt the curved surface C1 of the assembled flexible circuit board 120 to the appearance of the base 110.

Figure 5:
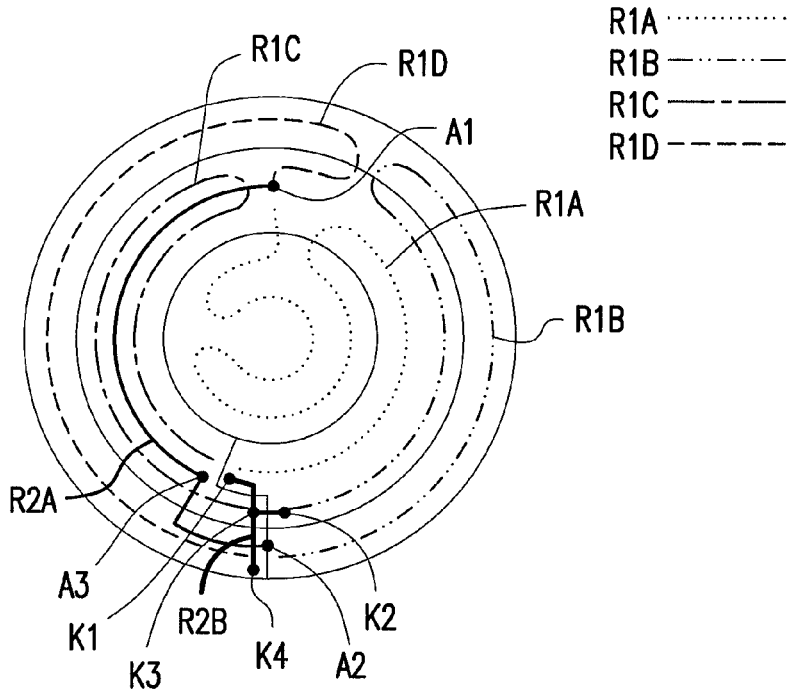
FIG. 5 is a schematic view illustrating wiring of the illumination device at the viewing angle shown in FIG. 2.
Figure 6A:
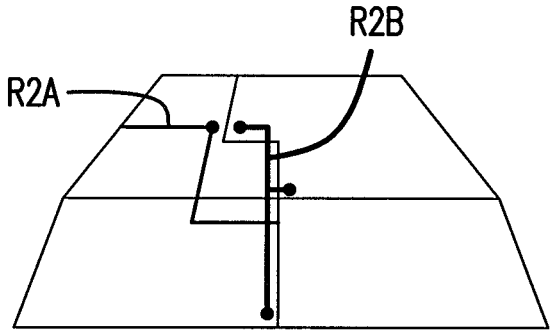
FIGS. 6A and 6B are schematic views illustrating wiring of the illumination device at the viewing angle shown in FIG. 3.
Figure 6B:
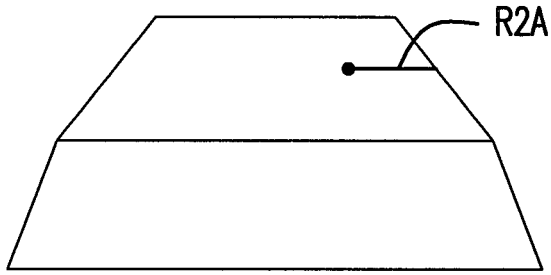

FIG. 5 is a schematic view illustrating wiring of the illumination device at the viewing angle shown in FIG. 2. FIGS. 6A and 6B are schematic views illustrating wiring of the illumination device at the viewing angle shown in FIG. 3. With reference to FIG. 4 to FIG. 6B, in the present exemplary embodiment, the flexible circuit board 120 further includes a plurality of second branches 122A and 122B, each of which extends from one of the first branches 121. After the assembly of the flexible circuit board 120, the second branches 122A and 122B underlie another of the first branches 121, such that the illumination units 130 on different first branches 121 can be electrically connected through the second branches 122A and 122B.

With reference to FIG. 4, in the flexible circuit board 120 described in the present exemplary embodiment, the second branch 122A extends from the arc-shaped branch 121C and has a section S1 extending in an arc-shaped manner along the radius R1 of curvature, a section S2 extending in an arc-shaped manner along the radius R3 of curvature, and sections S3 and S4 extending along a radial direction of the circular branch 121A. The second branch 122A has a second circuit R2A thereon. The second branch 122B extends from the arc-shaped branch 121E and has a section S5 extending in the radial direction of the circular branch 121A, and sections S6 and S7 extending in an arc-shaped manner along the radius R2 of curvature, and the second branch 122B has a second circuit R2B. An extension direction of the sections S3 and S4 of the second branch 122A is opposite to an extension direction of the section S5 of the second branch 122B, i.e., the sections S3 and S4 extend toward the direction of the circular branch 121A, and the section S5 extends in a direction away from the circular branch 121A. Thereby, after the flexible circuit board 120 is assembled, the second branches 122A and 122B underlie the first branches 121, i.e., the second branches 122A and 122B are overlapped and located between the base 110 and the first branches 121.

Figure 7:
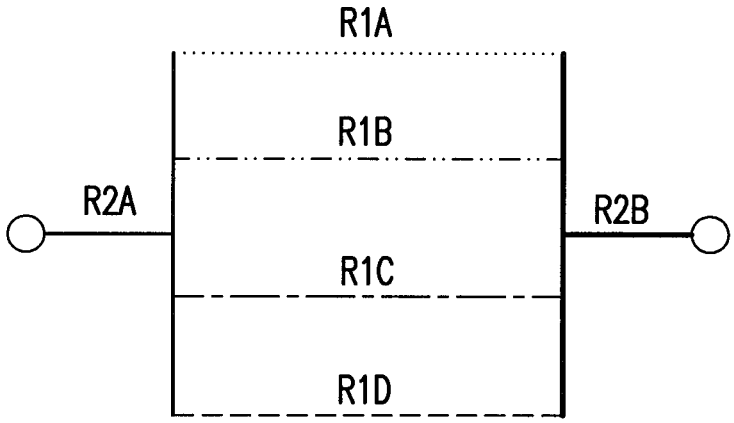
FIG. 7 is an equivalent system diagram illustrating the electrical connection depicted in FIG. 5.

FIG. 7 is an equivalent system diagram illustrating the electrical connection depicted in FIG. 5, so as to better depict the wiring configuration in FIG. 5. With reference to FIG. 5 to FIG. 7, in the present exemplary embodiment, the first branches 121 have a plurality of first circuits R1A, R1B, R1C, and R1D to serially connect the illumination units 130 on the first branches. Here, different types of line segments are provided to illustrate the first circuits R1A~R1D and the second circuits R2A and R2B. Particularly, in order for the assembled flexible circuit board 120 to, corresponding to the overlying illumination units with different wavelengths, achieve the desirable white light illumination effect through mixing the colors, the second circuits R2A and R2B of the second branches 122A and 122B and the first circuits R1A~R1D of the first branches 121 need be partially overlapped and electrically connected, so as to achieve parallel connection through the circuit board structure with different laminated layers.

For instance, as indicated in FIG. 4, FIG. 5, and FIG. 7, the first circuit R1A is distributed onto the circular branch 121A and the arc-shaped branch 121G, one end of the first circuit R1A is electrically connected to the second circuit R2A (contact A1) on the section S2, and the other end of the first circuit R1A is electrically connected to the second circuit R2B (contact K1) on the section S6. The first circuit R1B is distributed onto the arc-shaped branches 121F and 121C, one end of the first circuit R1B is electrically connected to the second circuit R2B (contact K2) on the section S7, and the other end of the first circuit R1B is electrically connected to the second circuit R2A (contact A2) on the section S1. The first circuit R1C is distributed onto the arc-shaped branches 121D and 121E, one end of the first circuit R1C is electrically connected to the second circuit R2A (contact A3) at the intersection of the sections S2 and S3, and the other end of the first circuit R1C is electrically connected to the second circuit R2B (contact K3) on the section S5. The first circuit R1D is distributed onto the arc-shaped branches 121B and 121D, one end of the first circuit R1D is electrically connected to the second circuit R2A (contact A1) at the intersection of the sections S2 and S4, and the other end of the first circuit R1D is electrically connected to the second circuit R2B (contact K4) on the section S5. Thereby, the electrical connection shown in FIG. 5 can be clearly shown in the electrical connection equivalent system diagram of FIG. 7.

Figure 8:
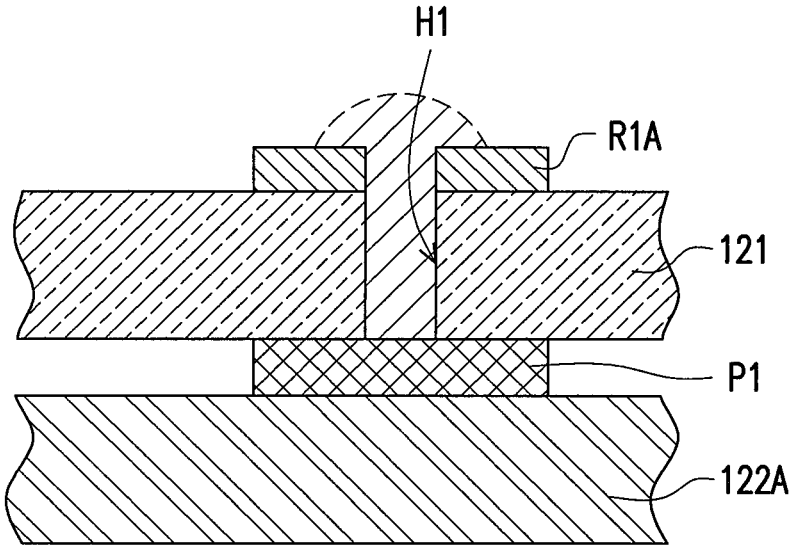
FIG. 8 is a partial cross-sectional view illustrating the illumination device depicted in FIG. 5.

FIG. 8 is a partial cross-sectional view illustrating the illumination device depicted in FIG. 5, indicating the electrical connection of the overlapping portions of the first branches 121 and the second branches 122A and 122B. With reference to FIG. 5 and FIG. 8, in the present exemplary embodiment, the first branches 121 have a plurality of through holes H1, and an end of each of the through holes H1 is where the first circuits R1A~R1D are located. Here, the first circuit R1A is taken for example. The second branches 122A and 122B have a plurality of pads P1 located on the second circuits R2A and R2B, and the second branch 122A is exemplarily shown herein. After the assembly of the flexible circuit board 120, the first branches 121 are overlapped with the second branches 122A and 122B, such that the through holes H1 may correspond to the pads P1, and that the pads P1 and the first circuits R1A~R1D around the through holes H1 can be soldered. Thereby, the first circuits R1A~R1D and the second circuits R2A and R2B are electrically connected, and the illumination units 130 on different branches may be connected in parallel. As such, the complicated circuit layout arising from additionally configuring jumpers (not shown) on the surface of the flexible circuit board 120 can be effectively prevented.

In light of the foregoing, as described in the exemplary embodiments of the disclosure, the flexible circuit board in the illumination device is divided into the first branches, each of the first branches has a fixed radius of curvature, and the radii of curvature of the first branches are identical to or different from one another. Hence, after the first branches are assembled, the flexible circuit board with a curved profile can be formed, and the illumination units packaged on the flexible circuit board may emit light towards different directions. Thereby, in the disclosure, the scattering effect can be achieved as is accomplished by the conventional illumination device.

Besides, each of the first branches is assembled to one another through the second branches, and the illumination units located on one of the first branches may be electrically connected to the illumination units located on another of the first branches through the second branch. In other words, since the first branches and the second branches in the assembled flexible circuit board are overlapped, the flexible circuit board forms a three-dimensional circuit structure similar to that of a laminated board, so as to electrically connect the illumination units on different branches in a convenient manner. After the illumination units become three-dimensional, the electrical connections among the illumination units can be simplified effectively, and the difficulty of circuit layout on the flexible circuit board can be reduced.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. An illumination device comprising:

a base;

a flexible circuit board configured on the base and having a plurality of first branches and at least one second branch connected together, each of the first branches having a radius of curvature, the radii of curvature of the first branches being identical to or different from one another, such that the first branches are assembled to form a curved surface, the at least one second branch extending from one of the first branches, and the at least one second branch being overlapped with another of the first branches after the first branches are assembled; and a plurality of illumination units respectively packaged on the first branches of the flexible circuit board, the illumination units located on one of the first branches being electrically connected to the illumination units located on another of the first branches through the at least one second branch.

2. The illumination device as recited in claim 1, wherein the curved surface is a dome or a flat-topped cone.

3. The illumination device as recited in claim 1, wherein each of the first branches has a first circuit and at least one through hole, the at least one second branch has a second circuit and at least one pad, and after the first branches are assembled, the first circuit and the second circuit are soldered through the at least one through hole and the at least one pad corresponding to each other.

4. The illumination device as recited in claim 1, wherein the illumination units comprise one or more red light emitting diodes, one or more blue light emitting diodes, and one or more green light emitting diodes.

5. The illumination device as recited in claim 1, wherein the flexible circuit board has a trunk, and the first branches comprise:

a circular branch connected to an end of the trunk; and a plurality of arc-shaped branches, the arc-shaped branches having the same radius of curvature extending from the trunk to two respective sides differing from the circular branch.

6. The illumination device as recited in claim 5, wherein the at least one second branch extends from one of the arc-shaped branches and underlies another of the arc-shaped branches.

* * * * *